United States Patent [19]

Sprigg et al.

[11] 4,147,328

[45] Apr. 3, 1979

[54] MULTIPLE PULLEY BIN JACK

[76] Inventors: E. Glenn Sprigg, Blackwater, Mo. 65322; Everett O. Couch, Box 146, Nelson, Mo. 65347; Shelby D. Hendrix, Blackwater, Mo. 65322

[21] Appl. No.: 881,352

[22] Filed: Feb. 27, 1978

[51] Int. Cl.[2] ..... B66F 7/12

[52] U.S. Cl. ..... 254/89 R; 254/139

[58] Field of Search ..... 254/139, 139.1, 145, 254/89 R

[56] References Cited

U.S. PATENT DOCUMENTS

| | | | |
|---|---|---|---|
| 47,139 | 4/1865 | Thomas | 254/145 |
| 1,805,402 | 5/1931 | Johnson | 254/139 |
| 2,708,012 | 5/1955 | Talcott | 254/89 R |
| 2,993,679 | 7/1961 | Morgan | 254/89 R |

*Primary Examiner*—Robert C. Watson

*Attorney, Agent, or Firm*—Lowe, Kokjer, Kircher, Wharton & Bowman

[57] ABSTRACT

A jack device for supporting and raising grain bins of the type constructed from top to bottom. The jack has an A shaped frame and an outwardly inclined brace leg. Three fixed pulleys and a floating pulley receive a cable that may be taken up by a winch mounted on the frame. The floating pulley is equipped with a hook which engages the bin in a manner to hold it at an elevated position and to raise the bin as the cable is taken up by the winch. The multiple fixed pulley arrangement acts to distribute the forces over the frame to thereby increase the stability of the jack in handling large bins.

4 Claims, 3 Drawing Figures

MULTIPLE PULLEY BIN JACK

BACKGROUND AND SUMMARY OF THE INVENTION

This invention relates to an improved jack device of the type used in constructing grain bins and the like.

One technique for assembling grain bins in place is a top to bottom construction method. The top of the bin is first constructed and is initially held a short distance above the ground by a series of jacks in order for workers to successively add the lower portions of the bin while working essentially at ground level. Each added section of the bin is a circular panel which is secured to the lower edge of the next higher panel. The bin is intermittently raised by the jacks so that the panel sections may be added in succession by the workers without requiring them to work on ladders, scaffolds or the like.

As can be appreciated, the bin jacks which provide the sole support for the bin during the construction process must be sturdy devices and must be able to raise even the largest bins relatively easily and without undue delay each time a panel section is to be added to the bin.

The main problem with conventional jacks is that they lack the overall strength and stability required to handle large grain bins. It is common for the jack to rear up under the force of the large weights which are applied and which tend to topple the jack inwardly toward the bin, thus creating a hazard to workmen. A need therefore remains for a stronger and safer bin jack. The principal goal of the present invention is to meet that need.

More specifically, it is an object of the invention to provide a bin jack which is able to handle even the largest bins with enough stability to effectively resist the forces tending to upset the frame. In this respect, a multiple pulley system is utilized to distribute the load forces over the frame in a uniform fashion to increase the stability and provide resistance to the moment forces which tend to overturn the jack.

Another object of the invention is to provide a bin jack of the character described which is improved structurally and which is capable of handling the largest bins with ease.

In conjunction with the preceding object, it is an additional object of the invention to provide a bin jack wherein a sufficient mechanical advantage is obtained to permit the use of a manual winch for handling the largest loads that are encountered.

A further object of the invention is to provide a bin jack of the character described which is constructed with an inclined and extended brace leg. In conjunction with the multiple pulley system, weight is transferred to the relatively long brace leg to increase stability without requiring excessively heavy structural members.

Yet another object of the invention is to provide a bin jack of the character described which is simple and economical to construct and which requires minimal maintenance and repair.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views.

Figure 2:
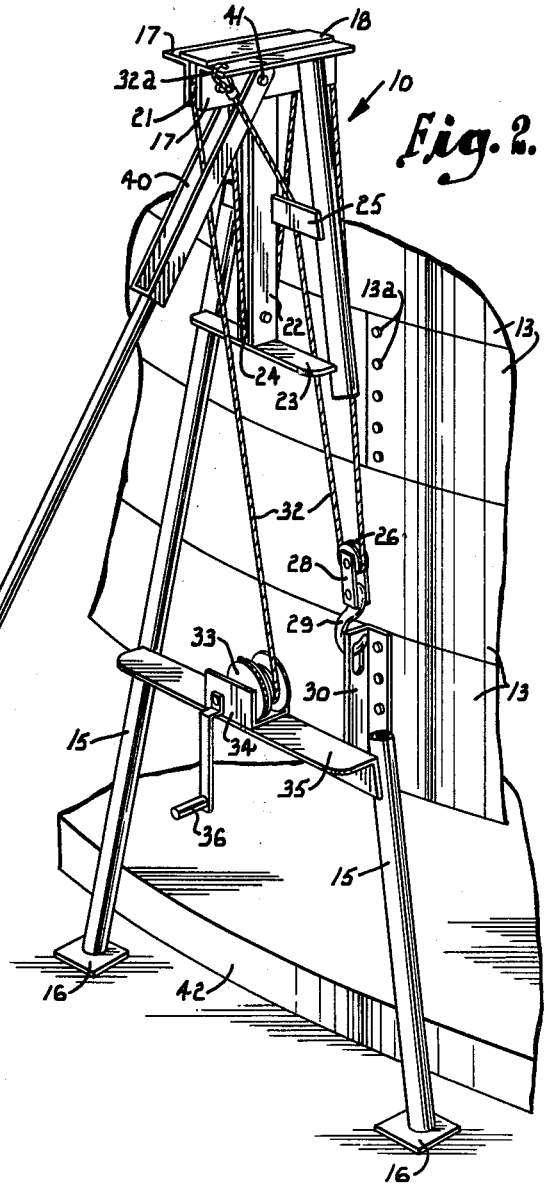
FIG. 2 is a perspective view showing one of the jacks applied to the bin, with a portion of one leg frame broken away for purposes of better illustration.

Referring now to the drawing in more detail, numeral 10 generally designates a bin jack constructed according to the present invention. A plurality of jacks 10 are used to assist in the construction of a grain bin 11 of the type that is assembled from top to bottom, as will be explained in more detail. The bin 11 includes a roof 12 and a plurality of metal panels which are connected edge to edge to form circular panel sections 13. To construct the bin, each panel section 13 is connected at its upper edge to the lower edge of the next higher panel section. The panels of the bin are connected by rivets **13*a*** (FIG. 2) or in any other suitable manner.

Each bin jack 10 has a generally A-shaped frame formed by a pair of downwardly diverging, tubular legs 15. The lower end of each leg 15 carries a flat foot plate 16 which provide a stable base for supporting the frame on the ground. At the top of the frame, a pair of angle members 17 have their vertical flanges spaced apart by a plate 18 which is welded to the upper surfaces of their horizontal flanges. The upper ends of legs 15 are welded to the undersides of the horizontal flanges of the respective angle members 17. The angle members 17 extend horizontally away from the grain bin, or in a direction perpendicular to the vertical plane containing legs 15.

Figure 1:
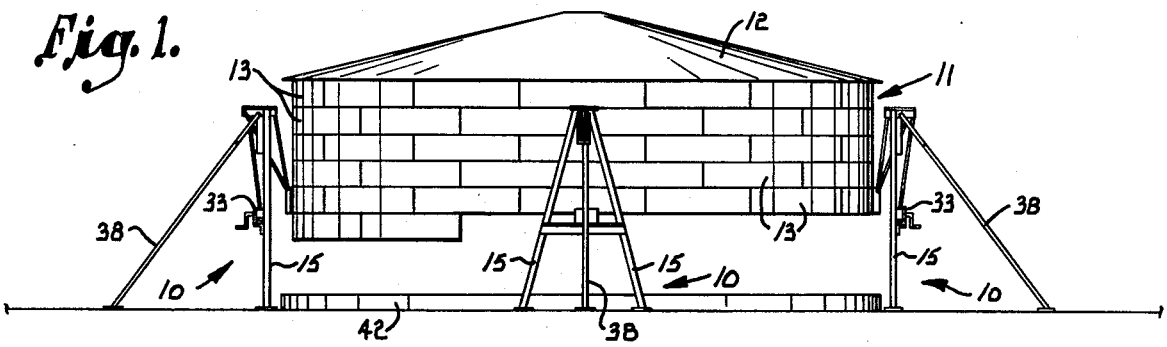
FIG. 1 is an elevational view showing a partially completed grain bin supported by bin jacks which are constructed in accordance with a preferred embodiment of the present invention.
Figure 3:
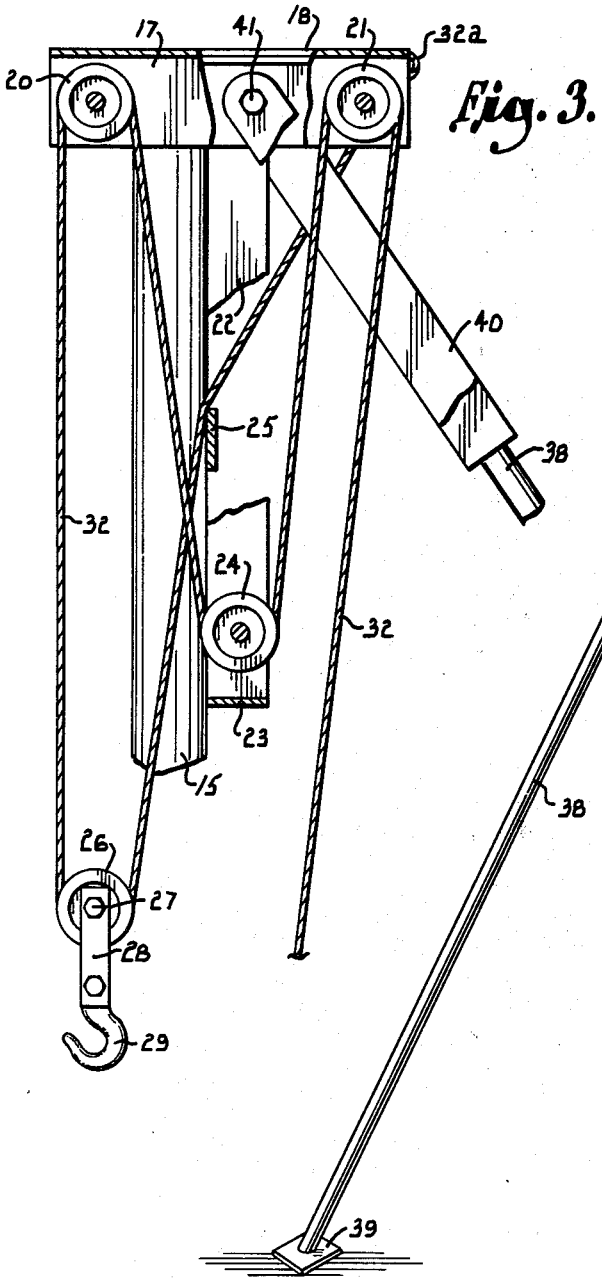
FIG. 3 is a fragmentary side elevational view on an enlarged scale showing the arrangement of the pulley system that is included in the bin jack, with portions broken away for purposes of better illustration.

With particular reference to FIG. 3, a fixed pulley 20 is mounted for rotation between the vertical flanges of angles 17 at a location near the inward ends of the angles or slightly inwardly of legs 15. Another fixed pulley 21 is likewise rotatably mounted between the angle members 17 near the opposite or outer ends thereof.

Extending downwardly from the vertical flanges of angle members 17 are a pair of flat bars 22 which are welded at their lower ends to a horizontal bracket plate 23 which is in turn welded to extend between legs 15. Bars 22 are spaced apart from one another and are oriented vertically at a location between the fixed pulleys 20 and 21. A third fixed pulley 24 is rotatably mounted between bars 22 at a location slightly above the bracket plate 23. Pulley 24 is thus located below each pulley 20 and 21 and approximately midway therebetween. A cross brace 25 is welded to each bar 22 and to each leg 15.

A floating pulley 26 is pinned at 27 to a pair of spaced bracket plates 28 extending downwardly from the pulley. A hook 29 pinned between the lower ends of plates 28 may be hooked in an opening formed in an angle member 30 (FIG. 2) which is secured to one of the end panels 13 of the grain bin.

A flexible cable 32 has one end looped at **32*a* and secured to one of the upper angle members 17 at the outer end thereof. The cable 32 extends downwardly over brace 25 and is received by the floating pulley 26 in a manner to support the same. The cable then passes upwardly and over the top of pulley 20, downwardly and beneath the lower fixed pulley 24, upwardly and over pulley 21, and downwardly around the drum of a winch 33 (FIG. 2) which functions to pay out and take up the cable. Winch 33 is mounted on a bracket 34 which is in turn secured to an angle 35 extending between legs 15 at a location well below plate 23. The winch is thus located below all of the fixed pulleys and well inwardly of the outer pulley 21. Cable 32 thus inclines slightly inwardly as it extends downwardly from pulley 21** to the winch.

Winch 33 may be equipped with a crank handle 36 or it may be turned by an electric motor or the like (not shown). The winch is preferably of the self locking type provided with a conventional ratchet mechanism (not shown) which act to automatically lock the drum against rotation in a direction that would pay out the cable.

An elongate inclined brace leg 38 carries a flat foot plate 39 on its lower end for engagement with the ground. Leg 38 is secured to a large clevis 40 at its upper end. The clevis 40 is in turn pivotally coupled by pin 41 to the angle members 17 at a location inward of the outer fixed pulley 21 and of the fixed end **32*a* of the cable 32 to insure stability of the jack. Leg 38** may be varied in length as needed to accomodate uneven terrain.

The jack device 10 is used to assist in the construction of bins such as the grain bin 11, as well as other similar structures. After the base 42 of the bin is laid, the upper panel section 13 is secured to the roof 12. The remaining panel sections 13 are then added in succession from top to bottom. A series of bin jacks 10, usually four in number, are spaced equally around the bin to hold the lowermost panel section 13 at an elevation slightly above the ground where workers can conveniently add the next lower section.

With the A frame of each jack 10 oriented vertically, hooks 29 are engaged with the angle pieces 30 secured to the side of the bin, and each winch 33 is turned in a direction to take up cable 32 until the floating pulley 26 is located at the desired elevation. The jack then holds the bin at this elevation while additional panel sections 13 are secured to the lower edge of the next higher panel section.

To raise the bin in order to permit the next lower panel section 13 to be added, winch 33 is rotated to effectively shorten cable 32 and thus raise the floating pulley 26. It is pointed out that the provision of the floating pulley results in a mechanical advantage and that the advantage could be increased if necessary by adding one or more additional floating pulleys to the system. It is further noted that pulley 20 is almost directly above pulley 26 so that the bin is raised straight upwardly.

Pulleys 20, 21 and 24 act to distribute the load over the frame in a direction outwardly of the bin to provide added stability and resistance to overturning. This arrangement shifts the applied forces outwardly on the frame in a direction toward the long brace leg 38 and, consequently, a greater part of the load is applied to the sturdy brace leg than would be the case in the absence of the multiple pulley system. Full advantage is thereby made of the tripod structure of the frame since the load is distributed more equally among the three legs when the brace leg 38 is pinned inwardly of the outer pulley 20 and the fixed end **32*a* of the cable and the takeup winch 33 is likewise mounted inwardly of the outer pulley 21**.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention, we claim:

1. A jack comprising:

an upright tripod frame including an A-shaped portion forming the front of said frame and further including a brace leg extending to the rear thereof with a pin connected to the upper end of said frame to permit limited pivotal movement of said brace leg;

a flexible cable having a fixed end secured to said frame to the rear of said pin of the brace leg;

a floating pulley receiving said cable and supported thereby for generally up and down movement in response to taking up and paying out of said cable;

load coupling means carried by said floating pulley for coupling to a load for the raising or lowering thereof in response to the raising or lowering of the floating pulley;

a first fixed pulley mounted on said frame at a location generally above said floating pulley to receive said cable;

a second fixed pulley mounted on said frame at a location generally above said floating pulley and to the rear of said pin of the brace leg to receive said cable;

take up means connected to said frame for taking up said cable from said second fixed pulley to thereby raise said floating pulley.

2. The jack as set forth in claim 1, wherein said take up means is mounted to said frame forwardly of said second fixed pulley.

3. The jack as set forth in claim 1, including a third fixed pulley mounted on said frame at a location generally between and below said first and second fixed pulleys, said cable being trained from said first fixed pulley to said third fixed pulley and then to said second fixed pulley.

4. A jack device as set forth in claim 3, wherein said first and second pulleys are located at substantially the same height above said third pulley.

* * * * *